US007293776B2

(12) United States Patent
Fenwick

(10) Patent No.: US 7,293,776 B2
(45) Date of Patent: Nov. 13, 2007

(54) PRACTICE TARGET FOR SPORT PROJECTILES

(75) Inventor: Daniel P Fenwick, Charlevoix, MI (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 10/916,263

(22) Filed: Aug. 11, 2004

(65) Prior Publication Data

US 2006/0033282 A1 Feb. 16, 2006

(51) Int. Cl.
*A63B 63/00* (2006.01)

(52) U.S. Cl. ..... 273/400; 273/127 R; 473/446

(58) Field of Classification Search ..... 273/398–402; 473/197, 476, 478, 195, 170, 172, 193, 456, 473/454, 196, 446
See application file for complete search history.

(56) References Cited

U.S. PATENT DOCUMENTS

| | | | | |
|---|---|---|---|---|
| 3,558,140 | A * | 1/1971 | Romeo | 473/164 |
| 4,153,246 | A * | 5/1979 | Byrne | 473/197 |
| 4,183,524 | A * | 1/1980 | Kifferstein et al. | 473/435 |
| 5,007,645 | A * | 4/1991 | Weigl et al. | 473/197 |
| 5,116,056 | A * | 5/1992 | Schmutte | 473/172 |
| 5,277,430 | A | 1/1994 | Naccarato | |
| 5,571,266 | A * | 11/1996 | Nichols | 473/446 |
| 5,664,784 | A * | 9/1997 | Redlich et al. | 273/396 |
| 5,876,291 | A * | 3/1999 | Dubose | 473/197 |
| 5,947,831 | A * | 9/1999 | McCarthy | 473/197 |
| 6,085,698 | A | 7/2000 | Klein | 119/859 |
| 6,860,825 | B2 * | 3/2005 | Clark | 473/478 |
| 6,969,068 | B1 * | 11/2005 | Pollon et al. | 273/400 |
| 6,997,573 | B2 | 2/2006 | Maese | 362/84 |
| 2001/0006074 | A1 * | 7/2001 | Zheng | 135/126 |
| 2002/0134518 | A1 | 9/2002 | Anderson | |
| 2002/0151387 | A1 | 10/2002 | Henson | |
| 2003/0125121 | A1 * | 7/2003 | Rhee | 473/195 |

* cited by examiner

*Primary Examiner*—Mark S Graham
(74) *Attorney, Agent, or Firm*—Harness, Dickey & Pierce, P.L.C.

(57) ABSTRACT

A target for practicing aiming sport or game projectiles, such as balls, hockey pucks, arrows, etc., is formed of a large, flexible sheet whose upper edge is temporarily secured to the lower edge of a conventional garage door when the door is lowered. The sheet is deployed to cover the garage door opening when the door is raised into open position. The sheet contains target markings which may include holes in the sheet for receiving propelled projectiles aimed at the target sheet. The target holes may be backed by pockets which receive and temporarily hold the projectiles which pass through the respective openings. The target holes may be normally covered by retractable flaps.

2 Claims, 3 Drawing Sheets

41
38
35
42
37
40
9
38
20
35
37
9

41
35
38
40
35
20

21
20
35
37
22

41
40
42
35
41

27
26
27
27
26
26

PRACTICE TARGET FOR SPORT PROJECTILES

BACKGROUND OF THE INVENTION

This invention relates to a target which is deployed over a conventional garage door opening for use in practicing propelling and aiming sport projectiles. The target is useful for practicing sports or games such as baseball, football, soccer, lacrosse, hockey, archery and similar sports which involve skillfully propelling a projectile, such as a ball or a puck, or an arrow, etc. to a particular place by the player. The practice target must be of substantial size, to be useful for the purpose of practicing propelling the game object or projectile and, must be easily transportable, easily stored when not in use and easily deployed when used or out of use.

An example of a suitable type of target, is illustrated and described in published application U.S. 2002/0151387-A1 of Scott C. Henson, published Oct. 17, 2002. That publication concerns a target in the form of a large sheet which is attached, along its upper edge and its side edges, to the frame of a garage door opening. An image, as for example, a picture of a hockey player or baseball player, is imprinted upon or attached to the sheet. The sheet may have target areas in the form of holes through which the projectiles pass. The holes may be provided with receptacles or pockets for receiving and temporarily holding projectiles that pass through the holes. The sheet may be temporarily deployed over the garage door opening for use and then disconnected and folded when not in use.

Other substantial size targets for practice purposes are illustrated in U.S. Pat. No. 5,993,334, issued Nov. 30, 1999 to Patrick E. McNamara for a practice backdrop and target. This patent illustrates a target sheet suspended from an overhead board or beam and rigged with cords along its sides which, when pulled, will raise the sheet out of the way or, alternatively, when manipulated will lower the sheet, similar to raising and lowering a window blind. The board or beam from which the sheet is suspended may be attached to the ceiling inside an automobile garage or other building.

A target sheet secured within a portable frame, and having target holes with receptacles or pockets for receiving a projectile that passes through the holes, is described in U.S. Pat. No. 5,934,679, issued Aug. 10, 1999 to Joseph W. Strain et al. for a bounce-back sports apparatus.

The foregoing targets which comprise large, flexible sheets, are difficult to deploy. For example, hanging a large, flexible sheet from an overhead beam or from the header of the frame of a garage door, requires considerable time and effort. Thus, arranging the target for use would be beyond the ability of children or many adults.

Since many sports require practice to develop the skills needed for propelling the sport projectile or object to particular locations, such as into a goal or to a person receiving the projectile, a simplified, easily deployed target would be useful for practicing aiming the projectile. Yet, because of the size of the target that is needed, a simplified system is desirable so that the target may be deployed and removed easily and within a short period of time, even by a child or unskilled adult.

Thus, the invention herein is concerned with providing a target and target deploying system which can easily and rapidly be deployed without tools, with virtually no skill, by almost anyone, and particularly for use by young children or adolescents who would otherwise be unable to deploy such a target.

SUMMARY OF THE INVENTION

This invention relates to a temporary target for use in practicing aiming various sports or game projectiles, such as balls, pucks, arrows, etc. The target is formed of a large sheet of flexible material, such as plastic sheeting or cloth sheeting. The sheet is provided with fasteners along its upper edge so that the sheet may be deployed over the conventional garage door opening by securing the sheet upper edge to the lower edge of the garage door when the garage door is closed and, thereafter, opening the garage door so as to lift the sheet and to hold it over the opening. Preferably, the sheet is provided with suitable images or indicia to provide visible targets. In addition, the sheet may be provided with target holes through which the projectiles may pass. Suitable pockets or bags may be attached to the sheet behind each of the holes for catching and temporarily holding the projectile after it passes through the hole. The holes may each be covered with a flap which, first, will serve as a target image and, second, folds or swings backwardly out of the way to uncover the hole when a projectile strikes it and passes through the hole.

To stabilize the sheet and prevent it from swinging or bowing when impacted by a thrown projectile, the sheet may be provided with vertical edge flaps that attach to their adjacent door jambs. The flaps may extend the full height of the door opening or may be formed by spaced-apart sections. In either case, "Velcro" strips may be attached, by sewing or by adhesive, to the flaps with corresponding strips attached to the jambs for temporarily securing the vertical edges of the sheet to the sides of the door opening.

Moreover, pockets may be sewn along the lower portion of the sheet for holding weights that tend to hold the sheet lower edge from swinging inwardly of the garage. Preferably, the weights may be in the form of conventional plastic milk bottles that may be filled with water. The bottles can be inserted in the pockets after the sheet is deployed and removed when the sheet is removed from the garage door.

An objective of this invention is to provide a target system by which the target sheet can be positioned over a garage door opening by securing the sheet to the lower edge of the closed garage door and then, by raising the garage door, suspending the sheet over the door opening. Thus, the target system may be easily deployed or removed with very little skill or strength required. Hence, it may be easily utilized by children and other persons of limited skill and strength.

Another objective of this invention is to provide a target which can be supported by a garage door and yet will not be near the garage door surface so as to avoid damage to the garage door by objects striking the target.

A further object of this invention is to provide a relatively inexpensive, easily foldable and easily stored target that may be used temporarily for short periods of time when desired.

Yet another object of this invention is to provide an inexpensive target that may be appropriately decorated with images and target points for use in practicing a number of different sport games.

These and other objects and advantages of this invention will become apparent upon reading the following description, of which the attached drawings form a part.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following is a description of a preferred embodiment and is not intended to limit the invention, its application, or its uses.

Figure 1:
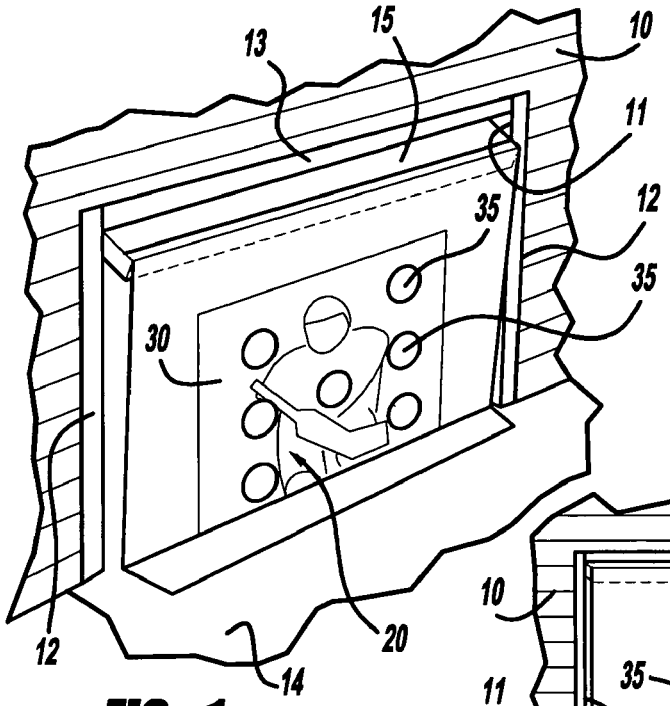
FIG. 1 is a fragmentary, perspective view, showing the target sheet supported by a garage door edge over the opening of the garage.
Figure 2:
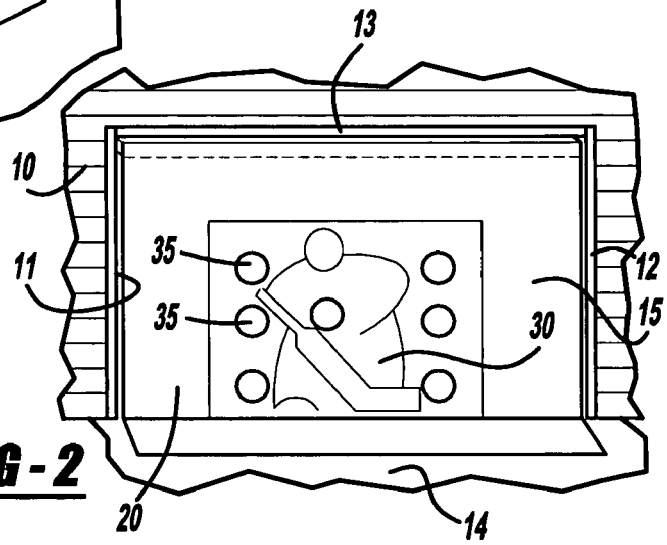
FIG. 2 is a fragmentary, elevational view showing a target sheet covering a conventional garage door opening.
Figure 3:
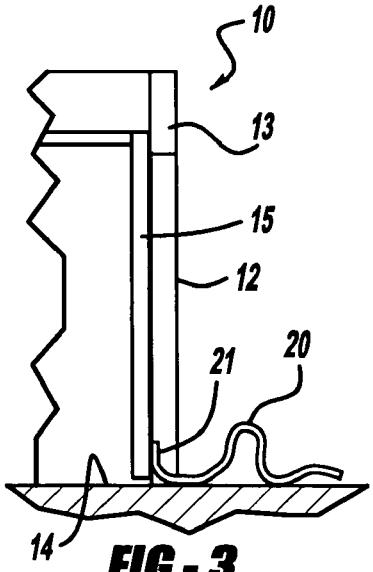
FIG. 3 is a schematic view showing the step of attaching the upper edge of the target sheet to the lower edge portion of a conventional garage door.
Figure 4:
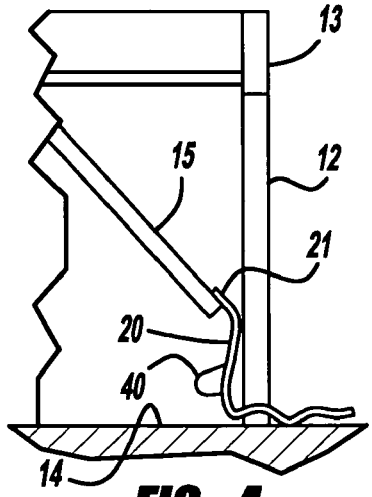
FIG. 4 schematically shows the garage door raising into the door open position and suspending the target sheet.
Figure 5:
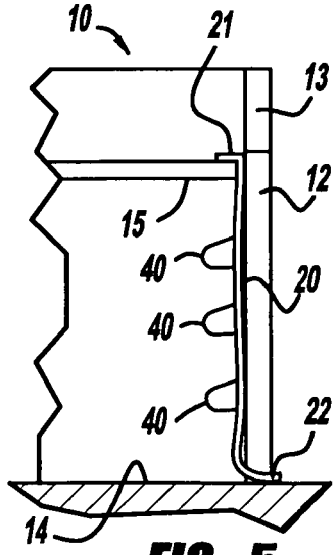
FIG. 5 schematically illustrates the garage door raised into full open position and the target sheet suspended from the edge of the door and covering the garage door opening.

Referring to the drawings, FIG. 1 and FIG. 2 schematically illustrate the front of a conventional garage 10 having a garage door opening 11. The opening, as is conventional, is formed with a frame having side jambs 12 and a header 13. A portion of the ground 14 located at the front of the garage is schematically shown.

A conventional garage door 15 is provided with a mechanism for raising the door for opening the garage and, reversely, to lower the door for closing the garage door opening. The door may be a single or double car garage door made of a single flat panel or it may be made of horizontal sections which swing or pivot relative to each other. The particular type of door is not material to the present invention, other than that the door should be of the type that moves upwardly to clear the door opening and moves downwardly to cover the door opening.

The target is formed of a sheet 20 which is preferably of sufficient size to substantially cover the garage door opening. The target sheet may be formed of a suitable sheet plastic or cloth material that is flexible and foldable. The target sheet has an upper edge portion 21 and a lower edge portion 22. Preferably, corresponding "Velcro" strips 26 and 27, which may be either of one continuous length or of short sections that are separated and aligned along the length of the upper edge of the sheet, are secured to the sheet. "Velcro" is a trademark which refers to a cooperating pair of cloth-like sheet material, or one of which has a hook-type of fiber and the other of which has an eye-type of fiber which interconnect. This is a commercially available material. Such material is commercially available in strips or sheets which are backed with a self-adhesive material so that the sheets or strips may be easily adhered to an object. Thus, by using the opposing hook and eye material formed in strips, they will interconnect. The strips 26 may be adhesively secured or sewn to the upper edge portion of the sheet. The corresponding Velcro strips 27 may be adhesively attached along the lower edge portion of the door. Thus, the upper edge portion of the sheet may be temporarily connected to the lower edge of the door when the door is lowered.

A suitable image 30 is either printed or painted directly upon the sheet 20. Alternatively, the image may be placed upon a separate sheet which in turn is fastened to the surface of the main sheet. The image may be a picture of a hockey player, such as a goalie, or a baseball catcher or other baseball player, or a lacrosse player, or a basketball player, or an animal such as a deer for archery practice, or the like.

In addition to the image, one or more target holes 35 may be formed in the sheet. The holes are of a size to pass the particular projectile which is hurled or propelled against the sheet. Thus, each of the holes form targets.

Preferably, each of the holes is normally covered with a retractable flap 36 which may be marked or colored to indicate a target. The flaps may be cut out of the main sheet, as illustrated by the edge cut 37 around each flap which leaves a partially uncut hinge area 38 connecting the flap to the sheet. Hence, the flap will swing or fold inwardly of the sheet, that is inwardly of the garage, when struck by a projectile.

Each hole is preferably provided with a pocket or socket 40 which may be made of cloth or mesh material, that is formed in a bag-like shape and having a peripheral flange 41 that is sewn or adhered to the rear surface of the sheet. The pocket receives and temporarily holds a projectile after the projectile passes through the respective hole.

Figures 6, 7, 8, 9, 10, 11:
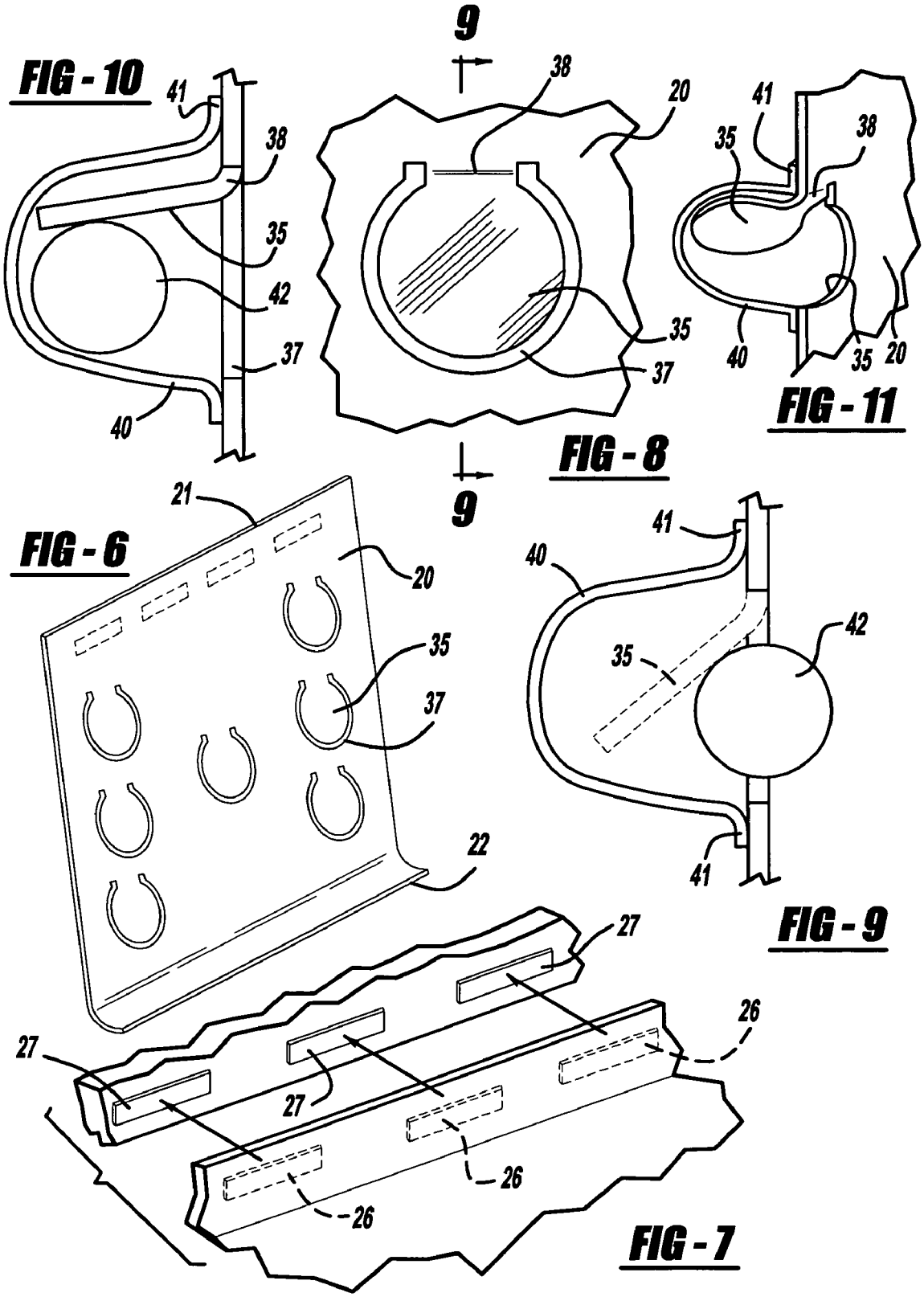
FIG. 6 shows a perspective view of a target sheet provided with a number of target holes, each closed by a flap.
FIG. 7 illustrates a fragmentary, perspective view, of a portion of the upper edge of the target shape and the lower edge portion of a door and schematically illustrating the use of "Velcro" sections, that is, hook and eye type of fabric connections, for securing the sheet upon the door.
FIG. 8 is an enlarged view of a hole in the target sheet covered by a flap.
FIG. 9 schematically illustrates a cross-sectional view taken in the direction of arrows 9-9 of FIG. 8 showing the flap swinging out of the way when struck by a projectile, in this case a ball, passing through the hole and into the pocket secured to the sheet behind the hole.
FIG. 10 is a view similar to FIG. 9, showing the projectile, i.e. the ball, fully within the pocket after it passes through the hole in the sheet.
FIG. 11 is a schematic, perspective view, of a fragment of the flap swung out of the way to clear the hole for passage of a projectile.
Figure 12:
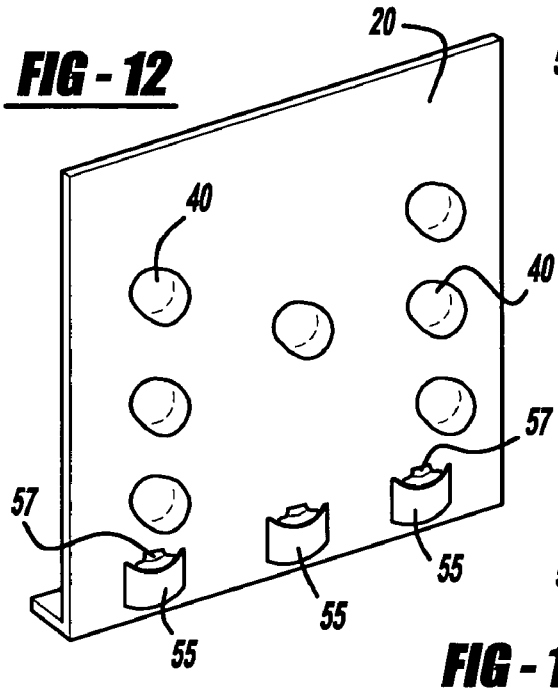
FIG. 12 is a rear, perspective view of the sheet illustrating the projectile receiving pockets and pockets for receiving weights.

FIG. 9 illustrates a ball 42 entering a hole and the flap swinging inwardly due to the impact of the ball. FIG. 10, illustrates a ball seated in the pocket after passing through the hole.

Figure 15:
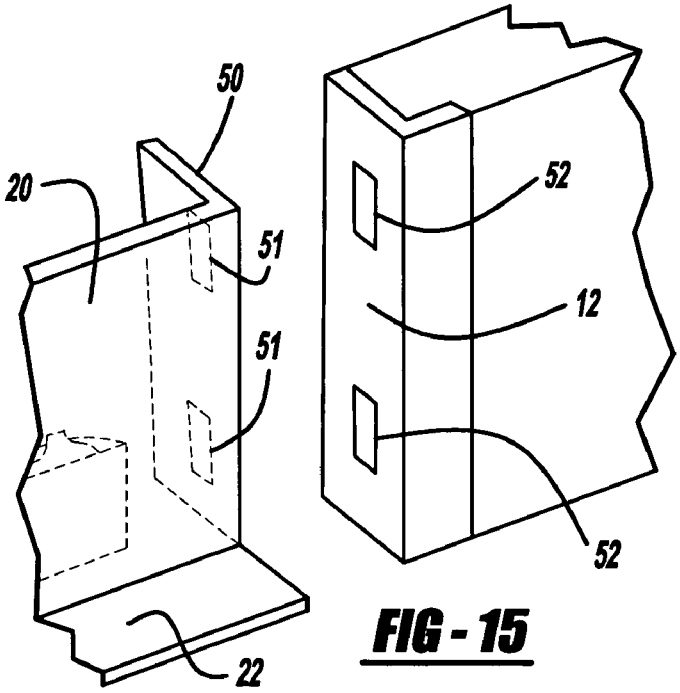
FIG. 15 is a fragmentary view of a side edge of the sheet adjacent a vertical edge of the door jamb.

Since the large sheet is flexible, it will tend to swing inwardly or bow inwardly under the impact of a projectile. Hence, in order to keep the sheet stable and to prevent the sheet from swinging inwardly on the garage in response to an impact, the vertical edges of the sheet, preferably, are connected to the jambs that define the doorway of the garage. To secure the vertical edges of the sheets to their adjacent jambs, flaps may be formed along the vertical lengths of the sheet. The flaps 50 may be in the form of separated sections, each of sufficient length to carry a "Velcro" strip 51 which may be sewn or secured by adhesive to their respective flaps. Alternatively, a single long vertical edge portion of the sheet may form an integrated flap (not shown). Where a typical garage has relatively thick or wide jambs, Velcro strips 52, which correspond to, and cooperate with, strips 51, are secured along the vertical surface of the respective jambs. (See FIGS. 13-15) Alternatively, where the doorway construction permits, the strips 52 may be secured on the outside or the inside surface of the jamb and correspondingly, the Velcro strips 51 may be formed along the vertical edge of the sheet adjacent the particular jamb face upon which the strips 52 are secured. The strips, which would be a conventional hook and eye, connectable, fabric, can be applied upon the sheet and correspondingly upon the jamb in locations which will enable it to be pressed together.

In operation, the user will lay the target sheet upon the ground in front of the garage. The sheet will be spread out flat upon the ground or folded into accordion strips that are parallel to the garage door opening. The upper end portion 21 of the sheet is positioned along the lower edge of the door. Then, with the garage door lowered or closed, the installer presses the upper edge of the sheet against the garage door lower edge portion so that the cooperating "Velcro" strips interconnect. Then, the garage door is raised into its open position. That will raise the sheet vertically so that the sheet now is deployed over and overlaps the garage door opening.

After the sheet is deployed by lifting the garage door upwardly so that the doorway is open, the person who is mounting the sheet in place, merely presses the opposite edges of the sheet against the area of the door jambs having the fasteners for them securing the side edges of the sheet against the jamb.

Figure 13:
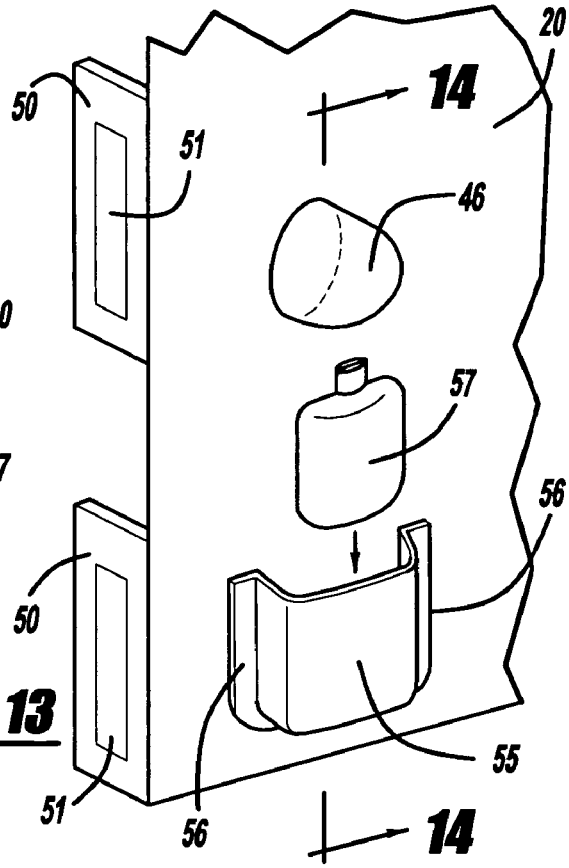
FIG. 13 is a fragmentary, perspective view of a rear, lower corner of the sheet, with a conventional milk bottle shown above a weight receiving pocket, and with sheet side flaps folded forwardly for securing to the door jambs.
Figure 14:
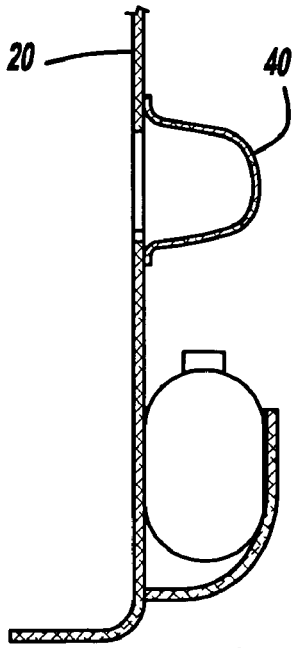
FIG. 14 is a cross-sectional, fragmentary view of a lower portion of the sheet taken in the direction of arrows 14-14 of FIG. 13.

Lastly, either before or after the sheet is lifted into vertical position, several gallon or half-gallon jugs or plastic bottles, such as conventional plastic milk bottles or other conventional beverage containers, may be filled with water and then manually placed into pockets along the lower edge of the sheet. As illustrated in FIGS. 13 and 14, the pockets 55 are arranged near the lower edge portion of the sheet and their side seems or flanges 56 may be sewn or easily secured to the sheet. The pockets are thus opened vertically upwardly and closed at their lower edges. The number of pockets provided may vary but a series of them may be placed along the lower edge of the sheet. Then, the plastic milk containers, without milk, are filled with water and put into the pockets. This provides a series of weights along the lower edge of the sheet to keep the sheet stretched and held in position. The containers may vary in size and shape. However, since plastic milk containers are commonly available and assuming that the target is used primarily for younger people, presumably enough empty milk containers would be available to any household for this purpose. Alternatively, other weights can be used, such as a brick or a stone or some other form of weight which provides enough downward force to hold the sheet taut.

When the sheet is suspended from the door, the door is out of the way so that the force of the impact of a projectile striking the sheet is not transmitted to the door. That avoids damaging of the door. After the target practice has concluded, that is, after the user has practiced throwing a ball or shooting a puck or hurling any other object at the target, the target may be removed by lowering the garage door. Then, the target sheet may be spread back out over the ground and folded and pulled free of the lower edge of the door.

Although it is preferred to secure the sheet to the door by the use of the hook and eye, Velcro-type strips, other types of fasteners could be used, such as mechanical fasteners formed of metal or plastic hooks and eye bolts or by tongues and grooves on the door and sheet.

Having fully described an operative embodiment of this invention, it is desired that the foregoing description be read as being merely illustrative and not in a strictly limiting sense. Thus, this invention may be further developed within the scope of the following claims:

What is claimed is:

1. A temporary target for practicing aiming propelled sport projectiles, such as balls, pucks and other game projectiles from outside a conventional garage, comprising:

a large, flexible sheet having an upper edge and a lower edge and disposed to substantially cover a conventional garage door opening having a conventional garage door of the type which is raised for opening and lowered for closing the garage door opening, while substantially not protruding inside the garage or requiring the use of space within the garage or displacement of garage contents;

fasteners arranged along the upper edge of the sheet for temporarily connecting the upper edge portion of the sheet to the lower edge portion of a garage door when the door is arranged in lowered position;

corresponding fasteners temporarily secured along the lower edge portion of the garage door in a way that does not require tools or penetration into the garage door;

bag-like pockets secured along the lower edge portion of the sheet and being open upwardly for receiving weights; and a series of weights positioned within the bags for holding the sheet downwardly and maintaining it relatively taut when the sheet is deployed over the door opening;

said weights being in the form of conventional plastic milk containers normally filled with water for providing the weight for holding the sheet downwardly, under the force of gravity;

with target markings formed on the surface of the sheet;

whereby the sheet may be deployed over the garage door opening by securing the upper edge of the sheet to the garage door lower edge portion when the door is lowered into closed position by inter-engaging the respective fasteners along the upper edge of the sheet and the lower edge portion of the garage door, and then raising the door into the door open position, and the target may be removed by lowering the door to collapse the sheet upon ground adjacent the garage door opening and disconnecting the fasteners.

2. A temporary target for practicing aiming propelled sport projectiles, such as balls, pucks and other game projectiles, comprising:

a large, flexible sheet of a size to substantially cover a conventional garage door opening having a conventional garage door of the type which is raised for opening and lowered for closing the garage door opening, with the sheet having an upper edge and a lower edge;

fasteners arranged along the upper edge of the sheet for temporarily connecting the upper edge portion of the sheet to the lower edge portion of a garage door when the door is arranged in lowered position;

bag-like pockets secured along the lower edge portion of the sheet and being open upwardly for receiving weights; and a series of weights positioned within the bags for holding the sheet downwardly and maintaining it relatively taut when the sheet is deployed over the door opening;

said weights being in the form of conventional plastic milk containers normally filled with water for providing the weight for holding the sheet downwardly, under the force of gravity;

with target markings formed on the surface of the sheet;

whereby the sheet may be deployed over the garage door opening by securing the upper edge of the sheet to the garage door lower edge portion when the door is lowered into closed position, and then raising the door into the door open position, and the target may be removed by lowering the door to collapse the sheet upon ground adjacent the garage door opening and disconnecting the fasteners.

* * * * *